US009881567B2

(12) United States Patent
Wagener

(10) Patent No.: US 9,881,567 B2
(45) Date of Patent: Jan. 30, 2018

(54) FLICKER REDUCTION IN AN LCOS ARRAY

(71) Applicant: NISTICA, INC., Bridgewater, NJ (US)

(72) Inventor: Jefferson L. Wagener, Morristown, NJ (US)

(73) Assignee: NISTICA, INC., Bridgewater, NJ (US)

( * ) Notice: Subject to any disclaimer, the term of this patent is extended or adjusted under 35 U.S.C. 154(b) by 151 days.

(21) Appl. No.: 14/686,163

(22) Filed: Apr. 14, 2015

(65) Prior Publication Data

US 2016/0307522 A1 Oct. 20, 2016

(51) Int. Cl.
*G09G 3/36* (2006.01)
*G09G 3/20* (2006.01)

(52) U.S. Cl.
CPC ..... *G09G 3/3607* (2013.01); *G09G 3/2029* (2013.01); *G09G 3/3648* (2013.01); *G09G 3/3696* (2013.01); *G09G 2320/0247* (2013.01)

(58) Field of Classification Search
CPC ..... G09G 2320/0247; G09G 3/3607; G09G 3/3696
See application file for complete search history.

(56) References Cited

U.S. PATENT DOCUMENTS

| | | | | |
|---|---|---|---|---|
| 6,430,328 | B1 | 8/2002 | Culver et al. | |
| 6,721,473 | B1 | 4/2004 | Islam | |
| 6,847,479 | B1 | 1/2005 | Islam | |
| 6,882,771 | B1 | 4/2005 | Islam | |
| 6,956,687 | B2 | 10/2005 | Moon et al. | |
| 7,092,599 | B2 | 8/2006 | Frisken | |
| 7,116,862 | B1 | 10/2006 | Islam | |
| 7,123,833 | B2 | 10/2006 | Szczepanek et al. | |
| 7,126,740 | B2 | 10/2006 | Szczepanek et al. | |
| 7,339,714 | B1 | 3/2008 | Islam | |
| 7,397,980 | B2 | 7/2008 | Frisken | |
| 2002/0167509 | A1 | 11/2002 | Willis | |
| 2012/0002917 | A1 * | 1/2012 | Colbourne | G02B 6/356 385/17 |
| 2014/0023316 | A1 * | 1/2014 | McLaughlin | G02B 6/3518 385/17 |
| 2014/0285867 | A1 | 9/2014 | Wagener | |
| 2015/0009455 | A1 * | 1/2015 | Kemp | G02F 1/0121 349/75 |

FOREIGN PATENT DOCUMENTS

| | | | | |
|---|---|---|---|---|
| KR | 10-2003-0030272 | A | 4/2003 | |
| WO | 02-37464 | A1 | 5/2002 | |
| WO | WO 0237464 | A1 * | 5/2002 | G09G 3/3614 |

* cited by examiner

*Primary Examiner* — Amr Awad
*Assistant Examiner* — Andre Matthews
(74) *Attorney, Agent, or Firm* — Stuart H. Mayer; Mayer & Williams PC

(57) ABSTRACT

A method is provided for reducing flicker arising in pixels along an axis of a liquid-crystal based array such as a LCoS array. The pixels along the axis exhibit a common gray scale level. In accordance with the method, a plurality of digital data command sequences are selected that each drive a pixel at the common gray scale level. A first of the plurality of digital data command sequences is applied to a first pixel along the axis. A second of the plurality of digital data command sequences is applied to a second pixel along the axis. The second pixel is adjacent to the first pixel. The first and second digital command sequences give rise to voltages being applied to the two pixels which have frequency components that are opposite in phase and equal in magnitude.

5 Claims, 4 Drawing Sheets

| | | | | | | | | | |
|---|---|---|---|---|---|---|---|---|---|
| 100% | 100% | 100% | 100% | 80% | 50% | 40% | 20% | 10% | 5% |
| TS1 | TS2 | TS3 | TS4 | TS5 | TS6 | TS7 | TS8 | TS9 | TS10 |

FIG. 2

| | | | | | | | | | |
|---|---|---|---|---|---|---|---|---|---|
| 40% | 60% | 68% | 33% | 49% | 73% | 46% | 56% | 41.5% | 46.3% |
| TS1 | TS2 | TS3 | TS4 | TS5 | TS6 | TS7 | TS8 | TS9 | TS10 |

FIG. 3

FLICKER REDUCTION IN AN LCOS ARRAY

BACKGROUND

It is well known that flicker occurs in LCoS devices when they are operated in a digital drive mode. With a digital drive a pulse width modulation scheme encodes gray scale levels into a series of binary pulses. In this implementation the pulse width is not varied but the encoding is done with a sequence of bits. In order to avoid charge migration in the LCoS, the bits are applied with an alternating voltage that has a 50% duty cycle so that the average voltage is zero and the RMS is non-zero. The liquid crystal molecules, which have limited rotational viscosity, responds to the RMS of the voltage. Flicker arises because the viscosity of the liquid crystal molecules limit the molecules' ability to respond to a rapidly changing voltage.

SUMMARY

In accordance with one aspect of the invention, a method is provided for reducing flicker arising in pixels along an axis of a liquid-crystal based array such as a LCoS array. The pixels along the axis exhibit a common gray scale level. In accordance with the method, a plurality of digital data command sequences are selected that each drive a pixel at the common gray scale level. A first of the plurality of digital data command sequences is applied to a first pixel along the axis. A second of the plurality of digital data command sequences is applied to a second pixel along the axis. The second pixel is adjacent to the first pixel. The first and second digital command sequences give rise to voltages being applied to the two pixels which have frequency components that are opposite in phase and equal in magnitude.

BRIEF DESCRIPTION OF THE DRAWINGS

FIG. 2 shows an example of a frame with a sequence of 10 timeslices in which the ON state occupancy percentages assigned to the timeslices vary from 100% (for 5 of the timeslices) to 2% (for one of the timeslices).

FIG. 3 shows another example of a frame with a sequence of 10 timeslices.

DETAILED DESCRIPTION

Introduction—Obtaining Gray Scale Levels with a LCoS Array

The gray scale of any given pixel in a liquid crystal based array such as Liquid Crystal on Silicon (LCoS) array may be obtained by controlling the length of time that the pixel is in the ON state during each frame. Each frame may be divided into a sequence of timeslices. A given gray scale level can be achieved by maintaining the light directed onto the LCoS array at a fixed brightness and by either turning ON or OFF the particular pixel during certain time slices of the sequence such that the cumulative time in which the pixel is ON during the sequence is proportional to the desired gray scale for that pixel. This is done for every pixel of the array for every frame.

Figure 1:
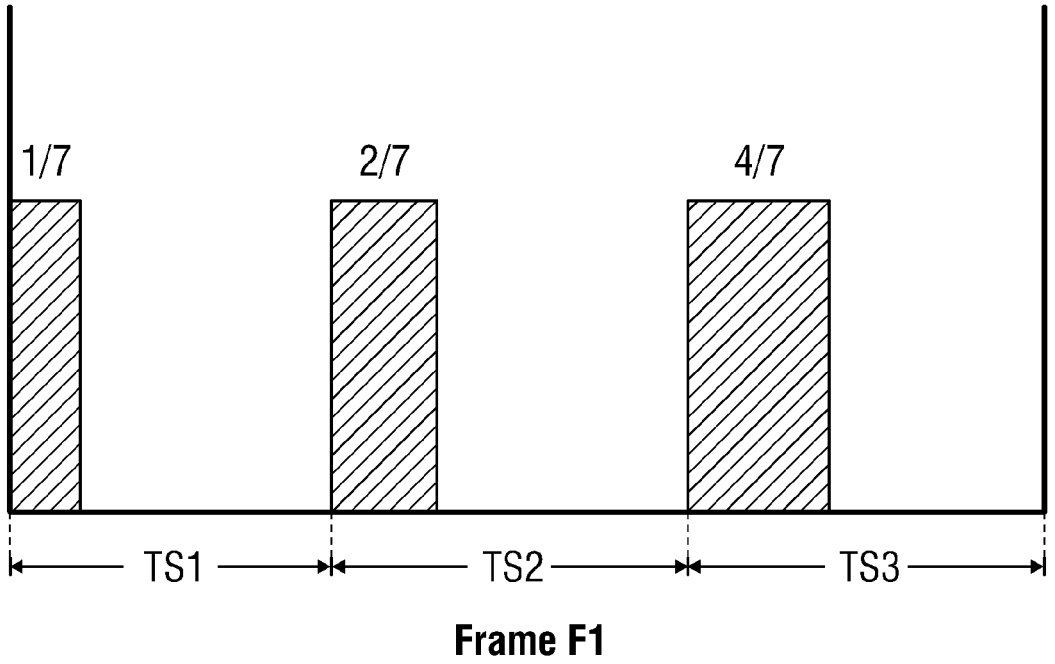
FIG. 1 shows a simple example of the pulse width modulation time domain scheme for obtaining a gray scale for an individual pixel in a liquid crystal based array.

Referring to FIG. 1, a simple example of the pulse width modulation time domain scheme for obtaining a gray scale is shown for an individual pixel. FIG. 1 is a graph illustrating the ON/OFF state of an individual pixel relative to time for a single frame. As described above, the perceived gray scale of each pixel increases with the cumulative time during each complete frame in which that pixel is in the ON state.

As shown in FIG. 1, frame F1 is divided into a sequence of timeslices TS of equal length in time. In this example, frame F1 is divided into a sequence of three timeslices with a pixel occupying $1/7^{th}$ of the first timeslice TS1 (i.e., $1/21^{st}$ of the length of overall frame F1), $2/7^{th}$ of the second timeslice TS2 (i.e., $2/21^{st}$ of the overall frame F1), and $4/7^{th}$ of the third timeslice TS3 (i.e., $4/21^{st}$ of overall frame F1). For each of these timeslices, a single binary bit is used to establish whether the pixel is in the ON or OFF state during each timeslice. Only one bit is required to determine the state of the pixel. Thus, digital data commands in the form of zeros and ones may be used to control the ON/OFF state of each pixel during any given timeslice. In this example, a zero (0) is used for turning a pixel OFF from an ON state or maintaining the pixel in an OFF state and a one (1) is used for turning a pixel ON from an OFF state or maintaining the pixel in an ON state.

By dividing the frame as described above into three timeslices of equal duration with each pixel occupying the specified fractional time period of each timeslice, eight levels of gray scale having equal changes in gray scale from level to level are achieved. These gray scale levels range from level 0, which corresponds to the pixel being in the OFF state throughout all three timeslices of the frame, to level 7, which corresponds to the pixel being in the ON state for a maximum of $7/21^{st}$ of the overall frame F1. Any of the gray scale levels between level 0 and level 7 may be obtained by turning ON the pixel during the appropriate timeslices.

As mentioned above, gray scale level 0 is obtained by turning OFF the pixel for all three timeslices TS1, TS2, and TS3 of the frame causing the pixel to be as dark as possible for that frame. This is a result of transmitting data commands zero (0) for each of the timeslices TS1, TS2, and TS3, which may be represented as a series of binary bits 0-0-0 with the first or most significant bit of the series corresponding to timeslice TS1, the second bit to timeslice TS2, and the third or least significant bit to timeslice TS3. Gray scale level 1 is obtained by turning ON the pixel during timeslice TS1 which is $1/7$ of the overall length of the frame time, and turning it OFF for timeslices S2 and S3.

Therefore, gray scale level 1 corresponds to data commands of one (1) for timeslice TS1, and zero (0) for timeslices S2 and S3, which may be represented as a series of binary bits 1-0-0. Gray scale level 2 is obtained by turning ON the pixel during only timeslice TS2, which is $2/7^{th}$ of the length of the frame. This causes the pixel to be ON for $2/7^{th}$ of the overall frame. Gray scale level 2 corresponds to data command 0-1-0. Using this three bit data command format, gray scale level 3 corresponds to data command 1-1-0, level 4 corresponds to command 0-0-1, level 5 to 1-0-1, level 6 to 0-1-1, and gray scale level 7 corresponds to data command 1-1-1, for which the pixel is ON for $7/21^{st}$ of the overall frame F1. Accordingly, for each successive gray scale level, the pixel is ON for an additional $1/7^{th}$ of the overall time of the frame and therefore results in a pixel brighter by $1/7^{th}$ of the maximum brightness than the previous gray scale level. Thus, including gray scale level 0, which corresponds to the pixel being OFF for all three timeslices, eight levels of gray scale are achieved with each level having equal changes in gray scale from level to level.

Although the above example describes dividing the frame into three timeslices in order to obtain eight levels of gray scale, it should be understood that this same technique may be applied to any number of timeslices into which the frame may be divided. By adding timeslices, the number of gray scale levels is increased by a factor of two for each timeslice added. Therefore, a sequence of four timeslices would provide 16 gray scale levels (0-15), five timeslices would provide 32 levels (0-31), and so on up to as many or more than eight timeslices, which would provide 256 levels of gray scale (0-255).

In addition, the fractional portion of a timeslice that is occupied by a pixel in the ON state is not limited to multiples of 1/7 as described above for illustrative purposes. More generally, any percentage between 0-100% may be assigned to a timeslice during which that timeslice is occupied by an ON state pixel. These percentages are often assigned by the LCoS manufacturer. For example, in one case the pixels of an LCoS are assigned a sequence of 10 timeslices per frame (corresponding to a 10 bit data command providing 10240 gray scale levels). FIG. 2 shows a frame with a sequence of 10 timeslices in which the ON state occupancy percentages assigned to the timeslices vary from 100% (for 5 of the timeslices) to 2% (for one of the timeslices).

Flicker

Flicker arises in an LCoS because the LCoS molecules are only able to respond to a rapidly changing applied voltage in a limited manner. That is, an LCoS acts like a low pass filter since the molecules cannot follow the application of high frequency voltages. The amount of flicker response will therefore depend on the applied voltage. As a consequence, different sequences of timeslices that give rise to the same gray scale level can exhibit different amounts of flicker. For example, consider the following two 8 bit sequences that may be applied to an LCoS. For simplicity the timeslices are assumed to be equal in duration with a 100% of the timeslices being occupied by a pixel in the ON state (i.e., when a bit of 1 is applied to the timeslice).

10101010 (sequence A)

11110000 (sequence B)

A pixel that is driven by the data commands of both sequences A and B give rise to the same gray scale level since in both cases the pixel is ON for 40% of the time. However, the two sequences will exhibit different amounts of flicker. The data command of sequence A gives rise to an applied voltage which has frequency components that include a lowest component $f_A$. Likewise, the data command of sequence B gives rise to an applied voltage which has frequency components that include a lowest component $f_B$. An examination of the two sequences shows that the lowest frequency component $f_A$ of sequence A is greater than the lowest frequency component $f_B$ of sequence B. That is, $f_A > f_B$. Accordingly, a pixel that is driven in accordance with sequence A will generally exhibit a lower flicker than if it were driven in accordance with sequence B.

By this same reasoning, different sequences of timeslices which have different ON state occupancy percentages (i.e., the fractional portion of a timeslice that is occupied by a pixel in the ON state) assigned to them will give rise to different amounts of flicker. For instance, the distribution of occupancy percentages shown for the 10 bit sequence shown in FIG. 2 will in general give rise to higher levels of flicker than the distribution of occupancy percentages shown for the 10 bit sequence shown in FIG. 3. This is because the sequence shown in FIG. 2 contains multiple timeslices with an occupancy percentage of 100%. Such high occupancy timeslices in effect concentrates applied voltage oscillations within a relatively small period of time, which causes the lowest frequency component of the applied voltage to be higher than a sequence such as shown in FIG. 3, for which there is no such concentration of applied voltage oscillations. As a consequence, the lowest frequency component of the applied voltage arising from the sequence of FIG. 3 is lower than for the sequence of FIG. 2. As a result the inherent flicker arising from use of a sequence of the type shown in FIG. 3 may be less than the inherent flicker arising from use of a sequence of the type shown in FIG. 2. It should be noted that the sequences shown in both FIGS. 2 and 3 allow a wide range of gray scale levels to be obtained with a relatively fine degree of granularity between levels.

Flicker Reduction in Individual Pixels

Accordingly, one way to reduce flicker is to assign ON state occupancy percentages to a sequence of timeslices taking into account the factors discussed above, while ensuring that the assigned percentages can provide the desired range of gray scale levels with the desired degree of granularity. Such sequences with ON state occupancy percentages that reduce flicker can be identified using well-known simulation techniques.

Once a sequence of timeslices having specified ON state occupancy percentages has been defined, an additional way to reduce flicker involves, for any given gray scale level that is desired, choosing a particular sequence of bits that has less flicker than other bit sequences that give rise to the same gray scale level. For instance, in the example presented above in which sequences A and B give rise to the same gray scale level, sequence A is preferred over sequence B because of its reduced flicker. Of course, the ability to choose low flicker bit sequences in this manner requires the availability of multiple sequences of bits that give rise to the same gray scale level. One way to ensure that there are many such degenerate sequences available is to use a sequence that has more bits than is required to achieve the desired number of gray scale levels. For instance, if 256 levels of gray scale are desired, then a sequence of 8 bits would suffice. However, if instead a sequence of more than 8 bits is used, there will be many more sequences available that give rise to each of the 256 gray scale levels. For example, if a sequence of 11 bits is employed, there are $2^{11}$ sequences available to choose from. Many of these bit sequences will give rise to the same gray scale level. The vast majority of these bit sequence will be relatively high flicker sequences and can be eliminated. Only a few of the $2^{11}$ sequences which have relatively low flicker and give rise to the required 256 gray scale levels that need be retained.

Flicker Reduction in an LCoS Pixel Array

Figure 4:
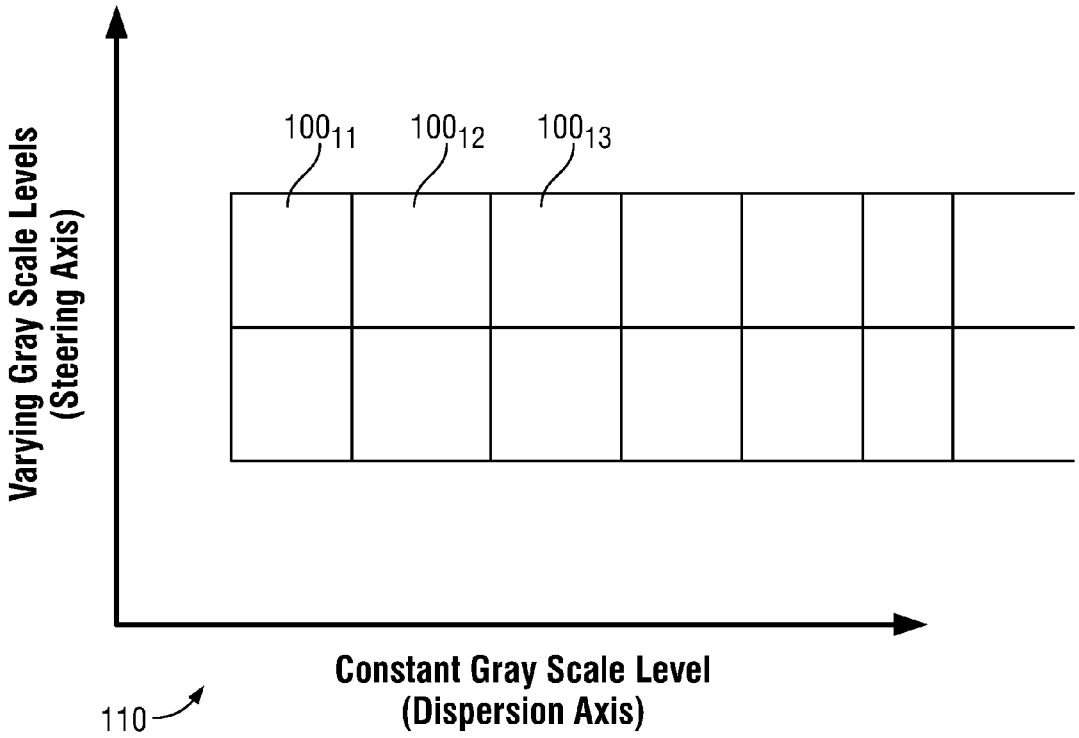
FIG. 4 shows a plan view of an LCoS array with pixels that extend in rows and columns along the x and y axes, respectively.

In some applications it is not the amount of flicker arising in any individual pixel that is of concern. For instance, FIG. 4 shows a plan view of an LCoS 110 with pixels 100 that extend in rows and columns along the x and y axes, respectively. For some purposes all the pixels in the same row or rows (or the same column or columns) are to be arranged to exhibit the same gray scale level. The pixels in the same columns (or the same rows), on the other hand, may exhibit varying gray scale levels.

If the pixels in a given row are all to exhibit the same gray scale level, bit sequences for pairs of adjacent pixels in the row may be selected so that the flicker arising in one of the pixels cancels out the flicker of the adjacent pixel.

For example, consider the row of pixels $\mathbf{100}_{11}$, $\mathbf{100}_{12}$, $\mathbf{100}_{13}$ . . . shown in FIG. 4 with adjacent pixels $\mathbf{100}_{11}$ and $\mathbf{100}_{12}$. Assume for simplicity that the pixels are driven by a digital data command sequence of 4 bits, with the timeslices in each sequence being equal in duration and being occupied 100% of time when the pixel in the ON state (i.e., when a bit of 1 is applied to the timeslice). Further assume that all the pixels in this row are to have a gray scale level corresponding to the pixels being ON for 50% of the time over the sequence. Such a gray scale level may be accomplished using any of the following 4 bit sequences:

1100 (Sequence C)

0011 (Sequence D)

10101 (Sequence E)

Figure 5:
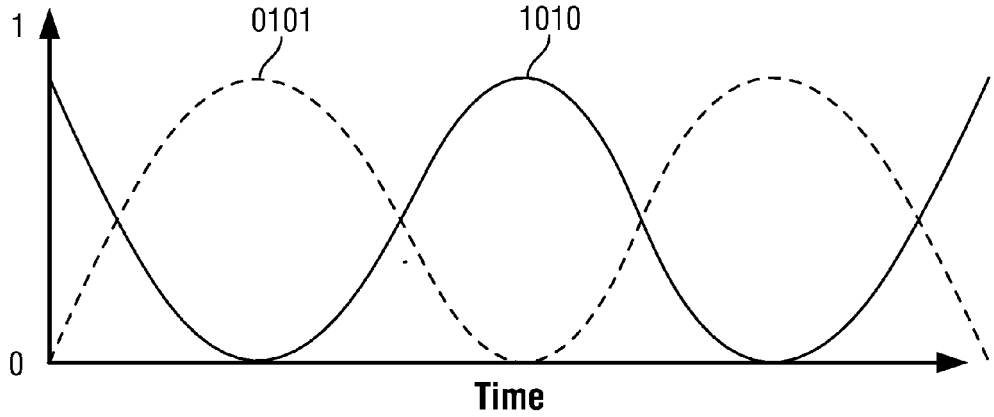
FIG. 5 shows the voltage as a function of time that is applied to one pixel in the array of FIG. 4 (solid line) and the voltage that is applied to the adjacent pixel (dashed line).

Bit sequences E and F are complementary in time and thus may be assigned to adjacent pixels in the same row (e.g., pixels $\mathbf{100}_{11}$ and $\mathbf{100}_{12}$ in FIG. 4) in order to cancel flicker in a pair-wise manner. The sequences are complimentary because as the voltage applied to one pixel is increasing (when a data command of bit 1 is applied) the voltage applied to the adjacent pixel is decreasing (when a data command of bit 0 is applied). That is, the complementary bit sequences give rise to voltages being applied to the two pixels which have low frequency components that are opposite in phase and about equal in magnitude. This complementary relationship is illustrated in FIG. 5, which shows the voltage as a function of time that is applied to pixel $\mathbf{100}_{11}$ using the 1010 sequence (solid line) and the voltage that is applied to pixel $\mathbf{100}_{12}$ using the 0101 sequence (dashed line). Such complementary bit sequences can reduce flicker for two reasons. First, as evident from the figure, the power level increase in one pixel occurs with a power level decrease in the other pixel. Second, because of fringing fields, the adjacent pixels are not truly independent of one another. Rather, the fringing fields give rise to crosstalk between the pixels, which in effect smoothes out the flicker of both pixels.

Thus, when a gray scale pattern is required from an LCoS which is constant along one axis and possibly varying along another axis, it is possible to cancel out flicker among pairs of pixels along the constant axis by using complementary bit sequence that prevent the coherent addition of flicker. It should be noted that when canceling out or reducing flicker in this manner it may not be necessary to select bit sequences for the individual pixels that minimize flicker for each of the pixels. Rather, in some cases, better flicker cancellation between adjacent pixels may be achieved when the flicker level of the individual pixels is relatively high.

Illustrative Wavelength Selective Switch

One example of a wavelength selective switch in which a LCoS array having reduced flicker of the type described herein may be incorporated will be described with reference to FIGS. 6A-6B. Additional details concerning this optical switch may be found in co-pending U.S. application Ser. No. 14/220,583 entitled "Wavelength Selective Switch Having Integrated Channel Monitor."

Figure 6A:
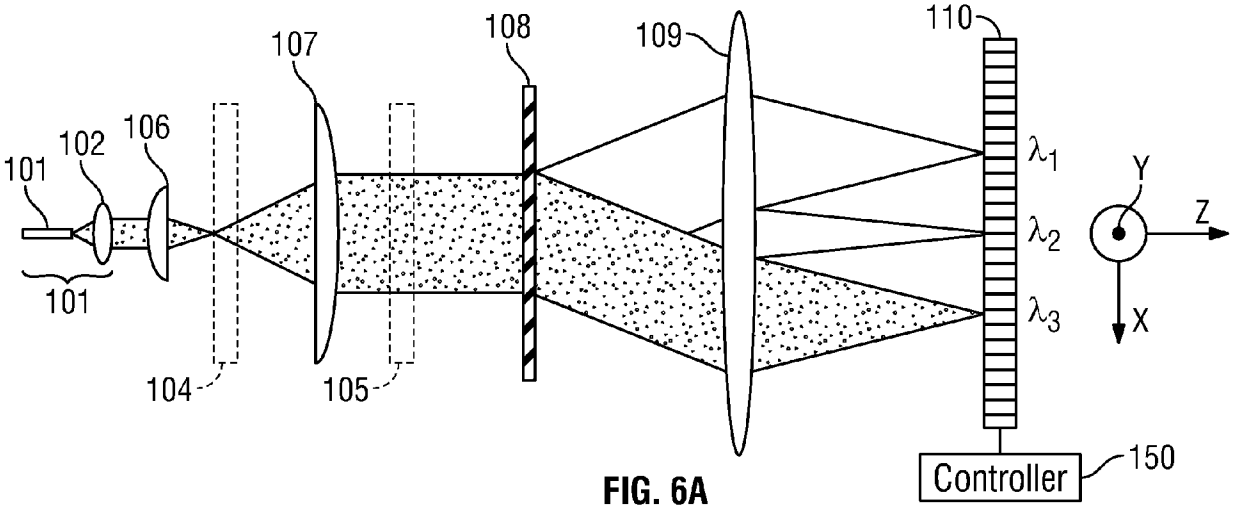
FIGS. 6A and 6B are top and side views respectively of one example of a simplified optical device such as a free-space WSS that may be used in conjunction with embodiments of the present invention.
Figure 6B:
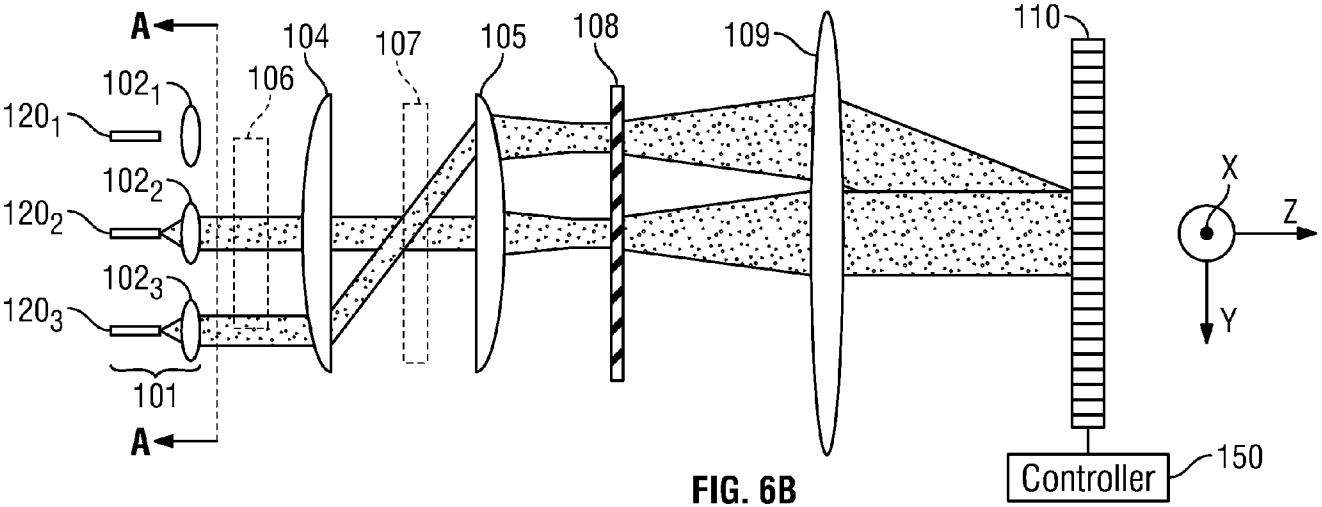

FIGS. 6A and 6B are top and side views respectively of one example of a simplified optical device such as a free-space WSS 100 that may be used in conjunction with embodiments of the present invention. Light is input and output to the WSS 100 through optical waveguides such as optical fibers which serve as input and output ports. As best seen in FIG. 6B, a fiber collimator array 101 may comprise a plurality of individual fibers $\mathbf{120}_1$, $\mathbf{120}_2$ and $\mathbf{120}_3$ respectively coupled to collimators $\mathbf{102}_1$, $\mathbf{102}_2$ and $\mathbf{102}_3$. Light from one or more of the fibers 120 is converted to a free-space beam by the collimators 102. The light exiting from port array 101 is parallel to the z-axis. While the port array 101 only shows three optical fiber/collimator pairs in FIG. 6B, more generally any suitable number of optical fiber/collimator pairs may be employed.

A pair of telescopes or optical beam expanders magnifies the free space light beams from the port array 101. A first telescope or beam expander is formed from optical elements 106 and 107 and a second telescope or beam expander is formed from optical elements 104 and 105.

In FIGS. 6A and 6B, optical elements which affect the light in two axes are illustrated with solid lines as bi-convex optics in both views. On the other hand, optical elements which only affect the light in one axis are illustrated with solid lines as plano-convex lenses in the axis that is affected. The optical elements which only affect light in one axis are also illustrated by dashed lines in the axis which they do not affect. For instance, in FIGS. 6A and 6B the optical elements 102, 108, 109 and 110 are depicted with solid lines in both figures. On the other hand, optical elements 106 and 107 are depicted with solid lines in FIG. 6A (since they have focusing power along the y-axis) and with dashed lines in FIG. 6B (since they leave the beams unaffected along the x-axis). Optical elements 104 and 105 are depicted with solid lines in FIG. 6B (since they have focusing power along the x-axis) and with dashed lines in FIG. 6A (since they leave the beams unaffected in the y-axis).

Each telescope may be created with different magnification factors for the x and y directions. For instance, the magnification of the telescope formed from optical elements 104 and 105, which magnifies the light in the x-direction, may be less than the magnification of the telescope formed from optical elements 106 and 107, which magnifies the light in the y-direction.

The pair of telescopes magnifies the light beams from the port array 101 and optically couples them to a wavelength dispersion element 108 (e.g., a diffraction grating or prism), which separates the free space light beams into their constituent wavelengths or channels. The wavelength dispersion element 108 acts to disperse light in different directions on an x-y plane according to its wavelength. The light from the dispersion element is directed to beam focusing optics 109.

Beam focusing optics 109 couple the wavelength components from the wavelength dispersion element 108 to a programmable optical phase modulator, which may be, for example, a liquid crystal-based phase modulator such as a LCoS device 110. The wavelength components are dispersed along the x-axis, which is referred to as the wavelength dispersion direction or axis. Accordingly, each wavelength component of a given wavelength is focused on an array of pixels extending in the y-direction. By way of example, and not by way of limitation, three such wavelength components having center wavelengths denoted $\lambda_1$, $\lambda_2$ and $\lambda_3$ are shown in FIG. 6A being focused on the LCoS device 110 along the wavelength dispersion axis (x-axis).

As best seen in FIG. 6B, after reflection from the LCoS device 110, each wavelength component can be coupled back through the beam focusing optics 109, wavelength dispersion element 108 and optical elements 106 and 107 to a selected fiber in the port array 101.

A controller or processor 150 selectively applies digital data command sequences that drive the pixels in the LCoS device 110 in order to steer each of the wavelength components. The controller 150 may be implemented in hardware, software, firmware or any combination thereof. For example, the controller may employ one or more processors, digital signal processors (DSPs), application specific integrated circuits (ASICs), field programmable gate arrays (FPGAs), discrete logic, or any combinations thereof. When the controller is implemented partially in software, a device may store computer-executable instructions for the software in a suitable, non-transitory computer-readable storage medium and may execute the instructions in hardware using one or more processors to perform the techniques of this disclosure.

The invention claimed is:

1. An optical device, comprising:

at least one optical input for receiving an optical beam and at least one optical output, the input and outputs extending along a common axis;

a dispersion element receiving the optical beam from the at least one optical input and spatially separating the optical beam into a plurality of wavelength components;

an optical system for magnifying the optical beam received from the at least one optical input and directing the magnified optical beam to the dispersion element, wherein the optical system has a first magnification factor in a first direction and a second magnification factor in a second direction orthogonal to the first direction, the first magnification factor being different from the second magnification factor;

a focusing element for focusing the plurality of wavelength components; and a liquid crystal based array for receiving the focused plurality of wavelength and steering the wavelength components to a selected one of the optical outputs;

a processor;

one or more computer-readable storage media containing instructions which, when executed by the processor perform a method for selectively applying digital data command sequences that drive pixels in the liquid crystal based array such that flicker that arises in pixels along an axis of the liquid crystal based array is reduced, the pixels along the axis exhibiting a common gray scale level, the method comprising:

applying a first of a plurality of digital data command sequences to a first pixel along the axis, each of digital data command sequences in the plurality of digital data command sequences being able to drive a pixel at the common gray scale level; and applying a second of the plurality of digital data command sequences to a second pixel along the axis, the second pixel being adjacent to the first pixel, wherein the first and second digital command sequences give rise to voltages being applied to the two pixels which have frequency components that are opposite in phase and equal in magnitude.

2. The optical device of claim 1, wherein the axis exhibiting the common gray scale level is a dispersion axis along which the wavelengths components of the optical beam are spatially separated by the dispersion element.

3. The optical device of claim 1 wherein the first direction is parallel to a wavelength dispersion axis along which the optical beam is spatially separated, the first magnification factor being less than the second magnification factor.

4. The optical device of claim 1, wherein the method performed by the processor further comprises selecting the first digital data command sequence to be applied to the first pixel so that the voltage applied to the first pixel has a lowest frequency component that is greater than a lowest frequency component of a voltage arising from any other digital data command sequence that causes the first pixel to be driven at the common gray scale level.

5. The optical device of claim 1, wherein the liquid crystal based array is a LCoS array.

* * * * *